US008225706B2

(12) United States Patent
Vigholm et al.

(10) Patent No.: US 8,225,706 B2
(45) Date of Patent: Jul. 24, 2012

(54) METHOD FOR CONTROLLING A HYDRAULIC CYLINDER AND CONTROL SYSTEM FOR A WORK MACHINE

(75) Inventors: Bo Vigholm, Stora Sundby (SE); Markku Palo, Eskilstuna (SE)

(73) Assignee: Volvo Construction Equipment AB, Eskilstuna (SE)

( * ) Notice: Subject to any disclaimer, the term of this patent is extended or adjusted under 35 U.S.C. 154(b) by 884 days.

(21) Appl. No.: 12/097,920

(22) PCT Filed: Jan. 16, 2007

(86) PCT No.: PCT/SE2007/000033

§ 371 (c)(1),
(2), (4) Date: Jun. 18, 2008

(87) PCT Pub. No.: WO2007/081278

PCT Pub. Date: Jul. 19, 2007

(65) Prior Publication Data

US 2008/0302099 A1 Dec. 11, 2008

Related U.S. Application Data

(60) Provisional application No. 60/759,996, filed on Jan. 18, 2006.

(30) Foreign Application Priority Data

Jan. 16, 2006 (SE) ..... 0600087-1

(51) Int. Cl.
*F15B 13/04* (2006.01)

(52) U.S. Cl. ..... 91/437

(58) Field of Classification Search ..... 91/436–438; 60/414

See application file for complete search history.

(56) References Cited

U.S. PATENT DOCUMENTS

| | | | | |
|---|---|---|---|---|
| 2,590,454 | A * | 3/1952 | Pilch | 91/438 |
| 3,604,313 | A * | 9/1971 | Fruehauf | 91/438 |
| 4,046,270 | A | 9/1977 | Baron et al. | |
| 4,509,405 | A * | 4/1985 | Bates | 91/436 |
| 5,072,584 | A * | 12/1991 | Mauch et al. | 91/437 |
| 5,140,895 | A * | 8/1992 | Imanishi | 91/437 |
| 5,826,486 | A * | 10/1998 | Shimada | 91/437 |
| 6,502,393 | B1 | 1/2003 | Stephenson et al. | |
| 2002/0125052 | A1 | 9/2002 | Naruse et al. | |
| 2004/0055289 | A1 | 3/2004 | Pfaff et al. | |
| 2004/0107699 | A1 * | 6/2004 | Fales et al. | 60/414 |
| 2005/0103006 | A1 | 5/2005 | Yoshino | |

FOREIGN PATENT DOCUMENTS

| | | | |
|---|---|---|---|
| WO | 03107242 | A1 | 10/2006 |
| WO | 2006132031 | A1 | 12/2006 |

* cited by examiner

*Primary Examiner* — Daniel Lopez
(74) *Attorney, Agent, or Firm* — WRB-IP LLP

(57) ABSTRACT

A method is provided for controlling a hydraulic cylinder, including detecting at least one operating parameter, and variably controlling a communication path between the piston-rod side and piston side of the hydraulic cylinder on the basis of the detected operating parameter.

23 Claims, 7 Drawing Sheets

METHOD FOR CONTROLLING A HYDRAULIC CYLINDER AND CONTROL SYSTEM FOR A WORK MACHINE

BACKGROUND AND SUMMARY

The present invention relates to a method for controlling a hydraulic cylinder and control system for a work machine.

The invention will be described below in connection with a work machine in the form of a wheel loader. This is a preferred but in no way limiting application of the invention. The invention can also be used for other types of work machines (or work vehicles), such as an excavator loader (backhoe) and excavating machine.

The invention relates, for example, to controlling lifting and/or tilting cylinders for operating an implement.

A known such control system for a work machine comprises at least one hydraulic cylinder and means for controlling a communication path between the piston-rod side and piston side of the hydraulic cylinder.

It is desirable to provide a method for controlling a hydraulic cylinder that permits energy-efficient operation of a work machine comprising the hydraulic cylinder.

According to an aspect of the present invention, a method is provided for controlling a hydraulic cylinder, comprising the steps of detecting at least one operating parameter, and of variably controlling a communication path between the piston-rod side and piston side of the hydraulic cylinder on the basis of the detected operating parameter.

More specifically, the piston side of the hydraulic cylinder can be connected directly to the piston-rod side. By continually variably controlling the communication path, it is possible to control a lowering or raising movement accurately on the basis of various operating parameters in order to achieve as rapid and/or energy-efficient movement as possible. The control of the communication path preferably involves controlling a pressure on a side of the cylinder that is opposite to the side of the cylinder toward which the piston in the hydraulic cylinder is moved. In other words, when lowering the load arm as described in the embodiment shown in FIGS. 1-2, the pressure is controlled on the piston-rod side and full flow can be achieved for maximum refilling of the piston-rod side. The pressure can be adjusted between zero and the pressure on the piston side. In a corresponding way, when raising the load arm, the pressure is controlled on the piston side. The communication path is preferably controlled by means of an electrically controlled valve, whereby the drop in pressure is controlled indirectly.

It is desirable to achieve a control system, preferably for a lift function and/or tilt function, that permits energy-efficient operation.

According to an aspect of the present invention, a control system is provided for a work machine comprising at least one hydraulic cylinder and means for controlling a communication path between the piston-rod side and piston side of the hydraulic cylinder, characterized in that a line connects the piston-rod side and the piston side, and that the control means is arranged on said line and is designed to be variably adjustable between two end positions.

The hydraulic cylinder is preferably adapted to move an implement in order to perform a work function. According to a first example, the hydraulic cylinder comprises a lifting cylinder for moving a load arm which is pivotably connected to a vehicle frame, the implement being arranged on the load arm. According to a second example, the hydraulic cylinder comprises a tilting cylinder for moving the implement which is pivotably connected to the load arm.

Further preferred embodiments and advantages of the invention emerge from the following description.

BRIEF DESCRIPTION OF THE DRAWINGS

The invention will be described in greater detail below with reference to the embodiments shown in the accompanying drawings, in which.

DETAILED DESCRIPTION

Figure 1:
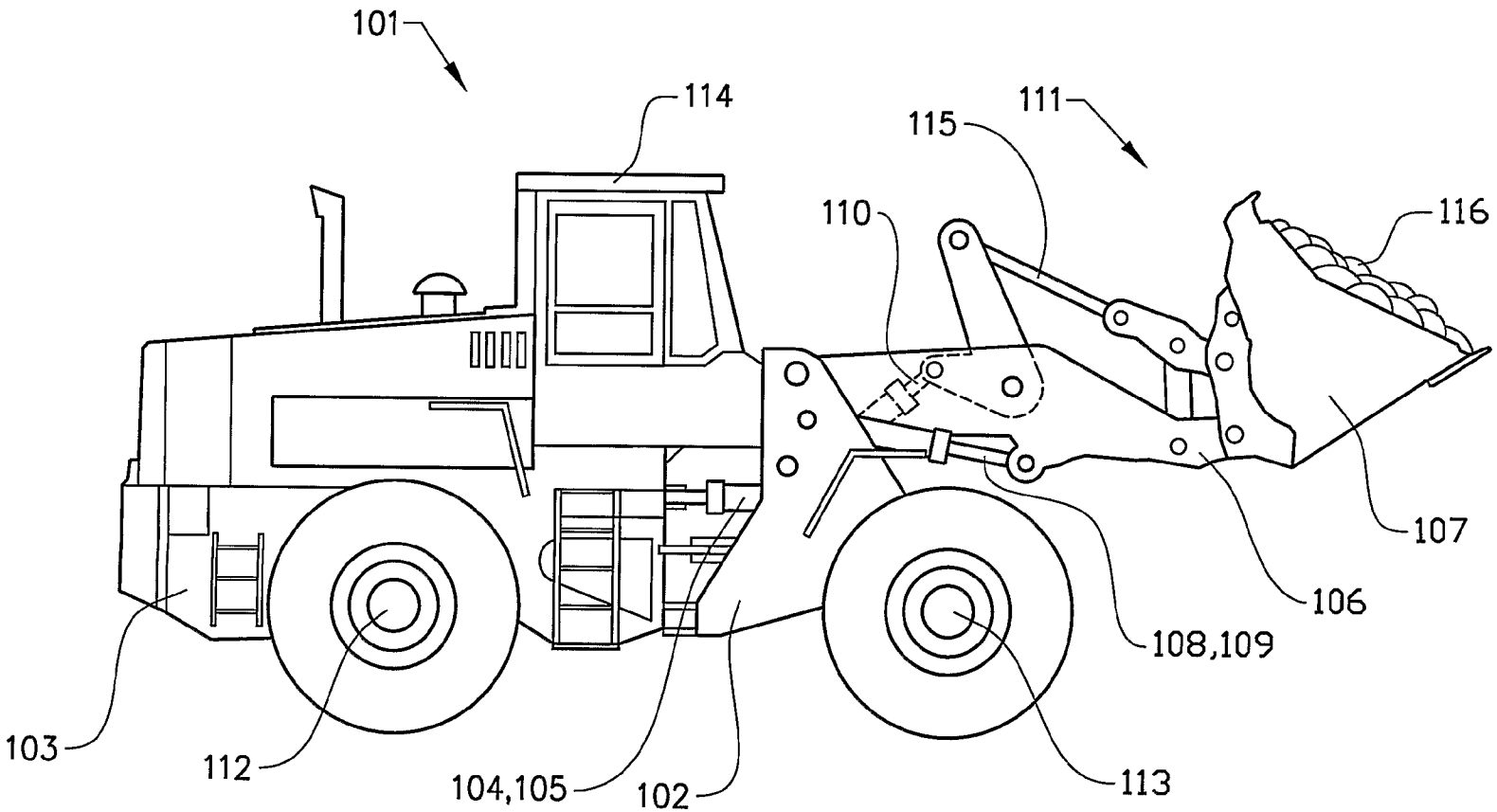
FIG. 1 shows a side view of a wheel loader.

FIG. 1 shows a side view of a wheel loader 101. The wheel loader 101 comprises a front vehicle part 102 and a rear vehicle part 103, which parts each comprise a frame and a pair of drive axles 112, 113. The rear vehicle part 103 comprises a cab 114. The vehicle parts 102, 103 are coupled together with one another in such a way that they can be pivoted in relation to one another about a vertical axis by means of two hydraulic cylinders 104, 105 which are connected to the two parts. The hydraulic cylinders 104, 105 are thus arranged on different sides of a center line in the longitudinal direction of the vehicle for steering, or turning the wheel loader 101.

The wheel loader 101 comprises an apparatus 111 for handling objects or material. The apparatus 111 comprises a lifting arm unit 106 and an implement 107 in the form of a bucket which is mounted on the lifting arm unit. Here, the bucket 107 is filled with material 116. A first end of the lifting arm unit 106 is coupled rotatably to the front vehicle part 102 for bringing about a lifting movement of the bucket. The bucket 107 is coupled rotatably to a second end of the lifting arm unit 106 for bringing about a tilting movement of the bucket.

The lifting arm unit 106 can be raised and lowered in relation to the front part 102 of the vehicle by means of two hydraulic cylinders 108, 109, which are each coupled at one end to the front vehicle part 102 and at the other end to the lifting arm unit 106. The bucket 107 can be tilted in relation to the lifting arm unit 106 by means of a third hydraulic cylinder 110, which is coupled at one end to the front vehicle part 102 and at the other end to the bucket 107 via a link arm system.

A number of embodiments of a control system for the hydraulic functions of the wheel loader 101 will be described in greater detail below. These embodiments relate to lifting and lowering of the lifting arm 106 via the lifting cylinders 108, 109, see FIG. 1. However, the various embodiments of the control system could also be used for tilting the bucket 107 via the tilting cylinder 110.

Figure 2:
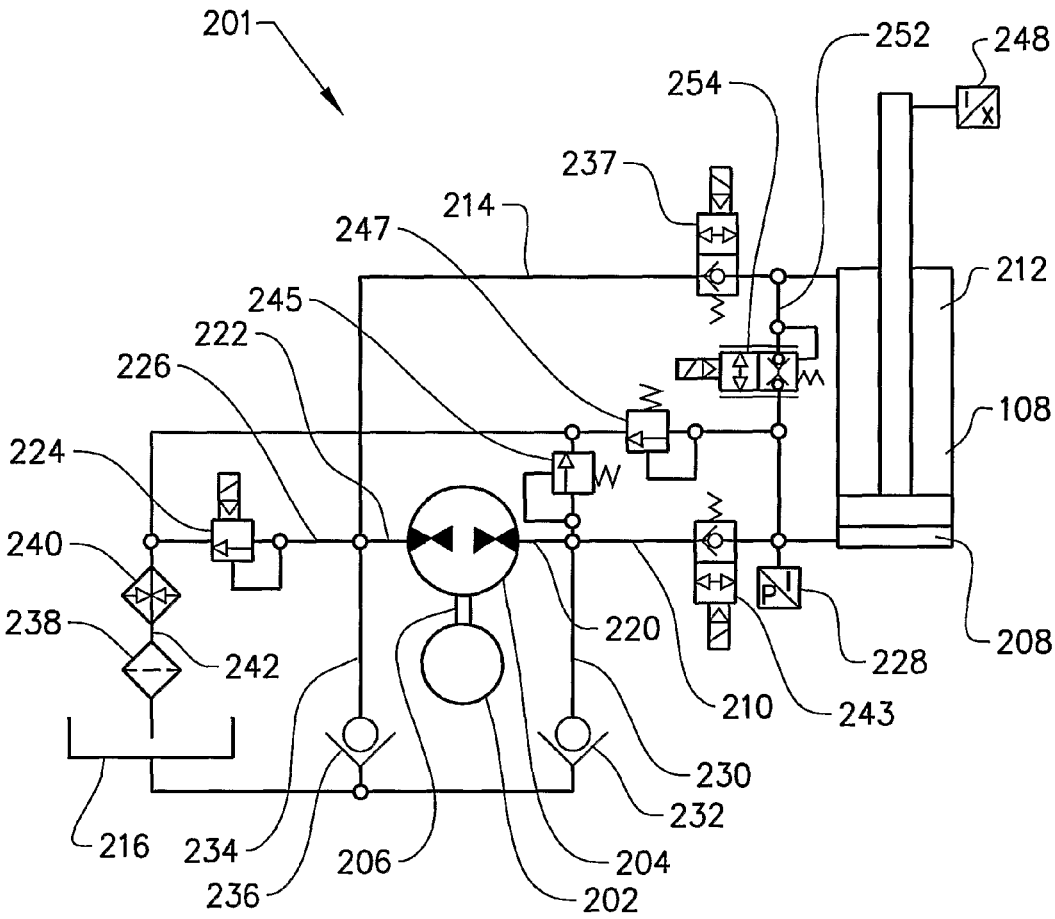
FIGS. 2-4 show three different embodiments of a control system for controlling a work function of the wheel loader.

FIG. 2 shows a first embodiment of a control system 201 for performing lifting and lowering of the lifting arm 106, see FIG. 1. The hydraulic cylinder 108 in FIG. 2 therefore corresponds to the lifting cylinders 108, 109 (although only one cylinder is shown in FIG. 2).

The control system 201 comprises an electric machine 202, a hydraulic machine 204 and the lifting cylinder 108. The electric machine 202 is connected in a mechanically driving manner to the hydraulic machine 204 via an intermediate drive shaft 206. The hydraulic machine 204 is connected to a piston side 208 of the hydraulic cylinder 108 via a first line 210 and a piston-rod side 212 of the hydraulic cylinder 108 via a second line 214.

The hydraulic machine 204 is adapted to function as a pump, be driven by the electric machine 202 and supply the hydraulic cylinder 108 with pressurized hydraulic fluid from a tank 216 in a first operating state and to function as a motor, be driven by a hydraulic fluid flow from the hydraulic cylinder 108 and drive the electric machine 202 in a second operating state.

The hydraulic machine 204 is adapted to control the speed of the piston 218 of the hydraulic cylinder 108 in the first operating state. No control valves are therefore required between the hydraulic machine and the hydraulic cylinder for said control. More precisely, the control system 201 comprises a control unit 502, see FIG. 5, which is electrically connected to the electric machine 202 in order to control the speed of the piston of the hydraulic cylinder 108 in the first operating state by controlling the electric machine.

The hydraulic machine 204 has a first port 220 which is connected to the piston side 208 of the hydraulic cylinder via the first line 210 and a second port 222 which is connected to the piston-rod side 212 of the hydraulic cylinder via the second line 214. The second port is thus separate from the first port. In addition, the hydraulic machine is arranged to be driven in two different directions, one direction being associated with a flow out from the first port and the second direction being associated with a flow out from the second port. The hydraulic machine is thus able to pump in both directions.

The second port 222 of the hydraulic machine 204 is moreover connected to the tank 216 in order to allow the hydraulic machine, in the first operating state, to draw oil from the tank 216 via the second port 222 and supply the oil to the hydraulic cylinder 108 via the first port 220.

The control system 201 comprises a means 224 for controlling pressure, which pressure means 224 is arranged on a line 226 between the second port 222 of the hydraulic machine 204 and the tank 216 in order to allow pressure build-up on the piston-rod side 212. More precisely, the pressure control means 224 comprises an electrically controlled pressure-limiting valve.

In addition, the control system 201 comprises a means 228 for detecting a load 116 acting upon the hydraulic cylinder 108. The load-detecting means 228 consists of or comprises a sensor 228 for detecting pressure on the piston side 208 of the hydraulic cylinder 108.

The first port 220 of the hydraulic machine 204 is connected to the tank 216 via a first suction line 230. A means 232, in the form of a non-return valve, is adapted to allow suction of hydraulic fluid from the tank and obstruction of a hydraulic fluid flow to the tank through the suction line 230.

The second port 222 of the hydraulic machine 204 is connected to the tank 216 via a second suction line 234. A means 236, in the form of a non-return valve, is adapted to allow suction of hydraulic fluid from the tank and obstruction of a hydraulic fluid flow to the tank through the suction line 234.

A means 237 for opening/closing is arranged on the second line 214 between the second port 222 of the hydraulic machine 204 and the piston-rod end 212 of the hydraulic cylinder 108. This means 237 comprises an electrically controlled valve with two positions. In a first position, the line 214 is open for flow in both directions. In a second position, the valve has a non-return valve function and allows flow in only the direction toward the hydraulic cylinder 108. During lifting movement, the electric valve 237 is opened and the rotational speed of the electric machine 202 determines the speed of the piston 218 of the hydraulic cylinder 108. Hydraulic fluid is drawn from the tank 216 via the second suction line 234 and is pumped to the piston side 208 of the hydraulic cylinder 108 via the first line 210.

An additional line 242 connects the second port 222 of the hydraulic machine 204 and the tank 216.

A means 243 for opening/closing is arranged on the first line 210 between the first port 220 of the hydraulic machine 204 and the piston end 208 of the hydraulic cylinder 108. This means 243 comprises an electrically controlled valve with two positions. In a first position, the line 210 is open for flow in both directions. In a second position, the valve has a non-return valve function and allows flow in only the direction toward the hydraulic cylinder 108.

If the bucket 107 should stop suddenly during a lowering movement (which can happen if the bucket strikes the ground), the hydraulic machine 204 does not have time to stop. In this state, hydraulic fluid can be drawn from the tank 216 via the suction line 230 and on through the additional line 242.

The electrically controlled valves 237, 243 function as load-holding valves. They are closed in order that electricity is not consumed when there is a hanging load and also in order to prevent dropping when the drive source is switched off. According to an alternative, the valve 237 on the piston-rod side 212 is omitted. However, it is advantageous to retain the valve 237 because external forces can lift the lifting arm 106.

A filtering unit 238 and a heat exchanger 240 are arranged on the additional line 242 between the second port 222 of the hydraulic machine 204 and the tank 216. An additional filtering and heating flow can be obtained by virtue of the hydraulic machine 204 driving a circulation flow from the tank 216 first via the first suction line 230 and then via the additional line 242 when the lifting function is in a neutral position. Before the tank, the hydraulic fluid thus passes through the heat exchanger 240 and the filter unit 238.

There is another possibility for additional heating of the hydraulic fluid by pressurizing the electrically controlled pressure limiter 224 at the same time as pumping-round takes place to the tank in the way mentioned above. This can of course also take place when the lifting function is used.

In addition, the electrically controlled pressure limiter 224 can be used as a back-up valve for refilling the piston-rod side 212 when lowering is carried out. The back pressure can be varied as required and can be kept as low as possible, which saves energy. The hotter the oil, the lower the back pressure can be, and the slower the rate of lowering, the lower the back pressure can be. When there is a filtration flow, the back pressure can be zero.

A first pressure-limiting valve 245 is arranged on a line which connects the first port 220 of the hydraulic machine 204 to the tank 216. A second pressure-limiting valve 247 is arranged on a line which connects the piston side 208 of the hydraulic cylinder 108 to the tank 216. The two pressure-limiting valves 245, 247 are connected to the first line 210 between the hydraulic machine 204 and the piston side 208 of the hydraulic cylinder 108 on different sides of the valve 243. The two pressure-limiting valves 245, 247, which are also referred to as shock valves, are spring-loaded and adjusted to be opened at different pressures. According to an example, the first pressure-limiting valve 245 is adjusted to be opened at 270 bar, and the second pressure-limiting valve 247 is adjusted to be opened at 380 bar.

When the work machine 101 is driven toward a heap of gravel or stones and/or when the implement is lifted/lowered/tilted, the movement of the bucket may be counteracted by an obstacle. The pressure-limiting valves 245, 247 then ensure that the pressure is not built up to levels which are harmful for the system.

According to a first example, the bucket 107 is in a neutral position, that is to say stationary in relation to the frame of the front vehicle part 102. When the wheel loader 101 is driven toward a heap of stones, the second pressure limiter 247 is opened at a pressure of 380 bar.

During ongoing lowering, the valve 243 on the first line 210 between the hydraulic machine 204 and the piston side 208 of the hydraulic cylinder 108 is open. When the lifting arm 106 is lowered, the first pressure limiter 245 is opened at a pressure of 270 bar. If an external force should force the loading arm 106 upward during a lowering operation with power down, the pressure limiter 224 on the line 226 between the second port 222 of the hydraulic machine 204 and the tank 216 is opened.

According to an alternative to the pressure-limiting valves 245, 247 being adjusted to be opened at a predetermined pressure, the pressure-limiting valves can be designed with variable opening pressure. According to a variant, the pressure-limiting valves 245, 247 are electrically controlled. If electric control is used, only one valve 247 is sufficient for the shock function. This valve 247 is controlled depending on whether the valve 243 is open or closed. The opening pressure can be adjusted depending on activated or non-activated lifting/lowering function and also depending on the cylinder position.

The first port 220 of the hydraulic machine 204 is connected to the piston-rod side 212 of the hydraulic cylinder 108 via a line 252 which connects the piston-rod side 212 and the piston side 208 of the hydraulic cylinder 108 in parallel to the hydraulic machine 204. A means 254 for controlling pressure, in the form of an electrically controlled pressure-reducing valve, is arranged on said parallel line 252 in order to control the communication path between the piston-rod side 212 and the piston side 208. By virtue of the valve 254, the maximum flow via the hydraulic machine 204 can be lowered, that is to say the pump displacement can be reduced or a lower maximum speed can be used.

The control means 254 that is arranged on the bypass line 252 is designed to be variably adjustable between two end positions. More specifically, the control means 254 consists of or comprises an electrically controlled proportional valve. In certain cases, it is not possible to recover all the energy from a lowering movement via the hydraulic machine 204. In such a case, a part of this excess energy can be consumed in the form of hydraulic thermal energy via the bypass valve 254. As the flow is known (for example from the hydraulic cylinder speed and/or engine speed) and the pressure drop across the bypass valve 254 can be adjusted to a certain extent, the quantity of energy consumed can be controlled by means of the bypass valve 254.

The pressure on the piston-rod side 212 should not be allowed to become too high. This pressure can be detected by means of a pressure sensor and can be controlled by the setting of the bypass valve 254.

If the pressure drop across the bypass valve 254 is maximal and the energy that is recovered is too high, the excess energy should be consumed elsewhere in the system, or alternatively the speed of lowering can be set at a lower level.

Different strategies for adjusting the bypass valve are described in greater detail below, with reference to FIGS. 6-11.

The control unit 502 is operatively connected to the control means 254 for controlling the setting of the latter. In addition, the control unit 502 is operatively connected to the load-detecting means 228 for controlling the control means 254 in response to a detected load value.

The pressure sensor 228 indicates whether the weight of the load is below or above a predetermined value, which indicates whether the load is considered to be light or heavy. For a lifting movement of a light load, the additional valve 254 is opened, which means that more rapid lifting can take place as a result of hydraulic fluid being supplied to the piston side 208 both from the hydraulic machine 204 and from the piston-rod side 212. The electric valve 237 on the second line 214 on the piston-rod side 212 is thus closed.

For a lifting movement of a heavy load, the electric valve 237 is opened on the second line 214 on the piston-rod side 212. The electric valve 254 on the parallel line 252 is closed. The lifting takes place more slowly due to the fact that all of the piston side 208 must be filled by the hydraulic machine 204.

With a light load, lowering can take place more rapidly, due to the fact that only the volume of the piston rod passes through the hydraulic machine 204. The additional valve 254 on the parallel line 252 is first opened. Prior to the lowering movement, pressurizing can take place, for example by the electric machine 202 being driven firstly with a certain torque in the "wrong direction", with the amount of torque being based upon the value of the pressure sensor 228 immediately prior to this. Alternatively, the hydraulic machine 204 rotates through a certain angle in the "wrong direction". Thereafter, the valve 243 on the first line 210 to the piston side 208 is opened, the direction of rotation of the hydraulic machine 204 is reversed and the lowering movement commences.

A lowering movement of a heavy load can be carried out as follows: The pressure sensor 228 indicates a heavy load. The additional valve 254 on the parallel line 252 is closed. In this position, all the flow from the piston side 208 passes through the hydraulic machine 204. The electrically controlled pressure limiter may need to be throttled to some extent in order to improve the refilling of the piston-rod side 212.

Figure 5:
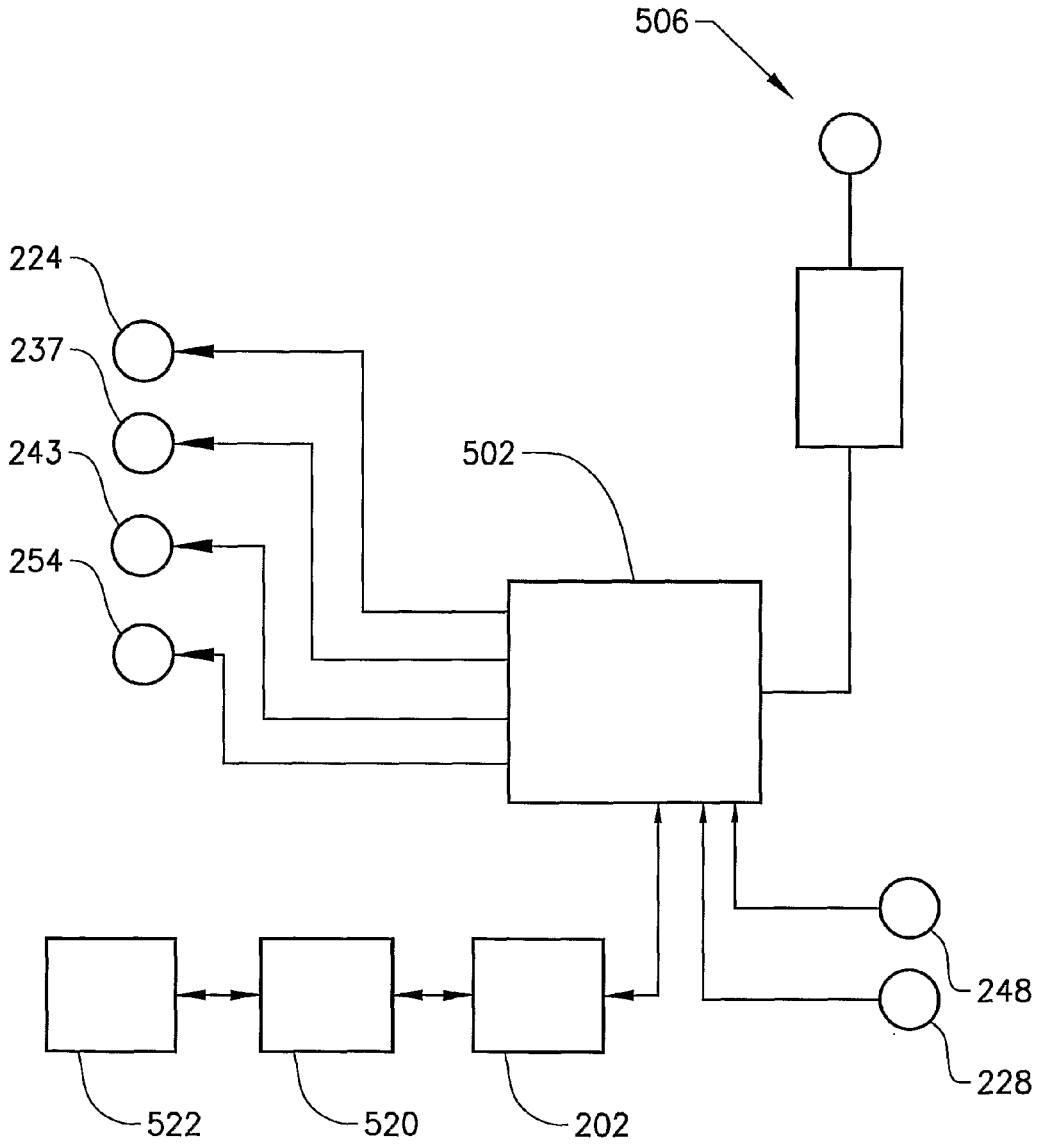
FIG. 5 shows a control system for controlling one or more of the functions of the wheel loader.

According to a preferred embodiment, the pressure sensor 228 thus detects a load acting upon the implement and generates a corresponding signal. The control unit 502, see FIG. 5, compares the size of the detected load with a predetermined load level. If the detected load is less than the predetermined load level, a corresponding signal is sent to the valve 254 that opens, whereby the piston-rod side 212 of the hydraulic cylinder 108 is connected to the piston side 208 so that hydraulic fluid from the piston-rod side flows to the piston side without passing through the hydraulic machine 204. If, instead, the detected load exceeds the predetermined load level, a corresponding signal is sent to the valve 237 that opens, whereby the piston-rod side of the hydraulic cylinder is connected to the second port 222 of the hydraulic machine 204 so that hydraulic fluid from the piston-rod side 212 flows to the second port of the hydraulic machine.

Figure 3:
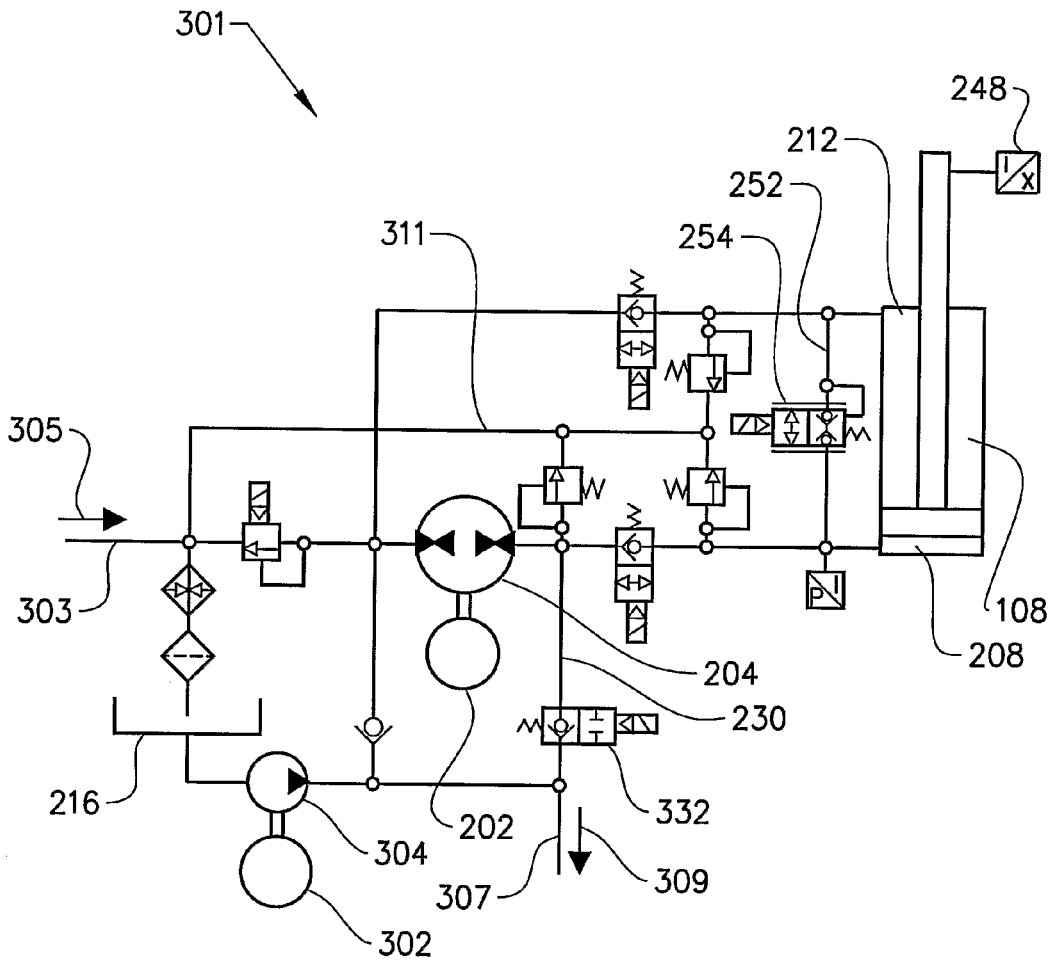

FIG. 3 shows a second embodiment of a control system 301 for carrying out raising and lowering of the lifting arm 106, see FIG. 1. Only the parts that distinguish the second embodiment from the first embodiment will be described below.

The control system 301 constitutes a part of a hydraulic system for controlling a plurality of the hydraulic functions of the wheel loader 101. For this purpose, the system 301 comprises a first line 303 for connection to a first such function and a second line 307 for connection to a second such function. The arrow 305 along the first line 303 indicates that the control system 301 is arranged downstream of the first function and the arrow 309 along the second line 307 indicates that the control system 301 is arranged upstream of the second function. The first line 303 leads to the piston side 208 and piston-rod side 212 of the hydraulic cylinder via an additional line 311, that branches off to each side via a pressure-limiting valve 313, 315.

The control system 301 comprises an additional hydraulic machine, in the form of a feed pump 304, that is connected to the tank 216 for pressurizing the hydraulic fluid that is drawn out of the tank An additional electric machine 302 is connected to the additional hydraulic machine 304 in the same way as described above for the electric machine 202 and the hydraulic machine 204.

The pump 304 provides increased refilling in the cylinder 108. In addition, the main unit (pump/motor) 202, 204 can be smaller and can be driven at a higher speed. In addition, the heat exchanger, filter, tank and feed pump can be common to several work functions.

Said means for allowing suction of hydraulic fluid from the tank 216 through the suction line 230 comprises or consists here of an electrically controlled on/off valve 332 instead of the non-return valve 232. In this way, any problems with cavitation on the suction side are reduced.

Figure 4:
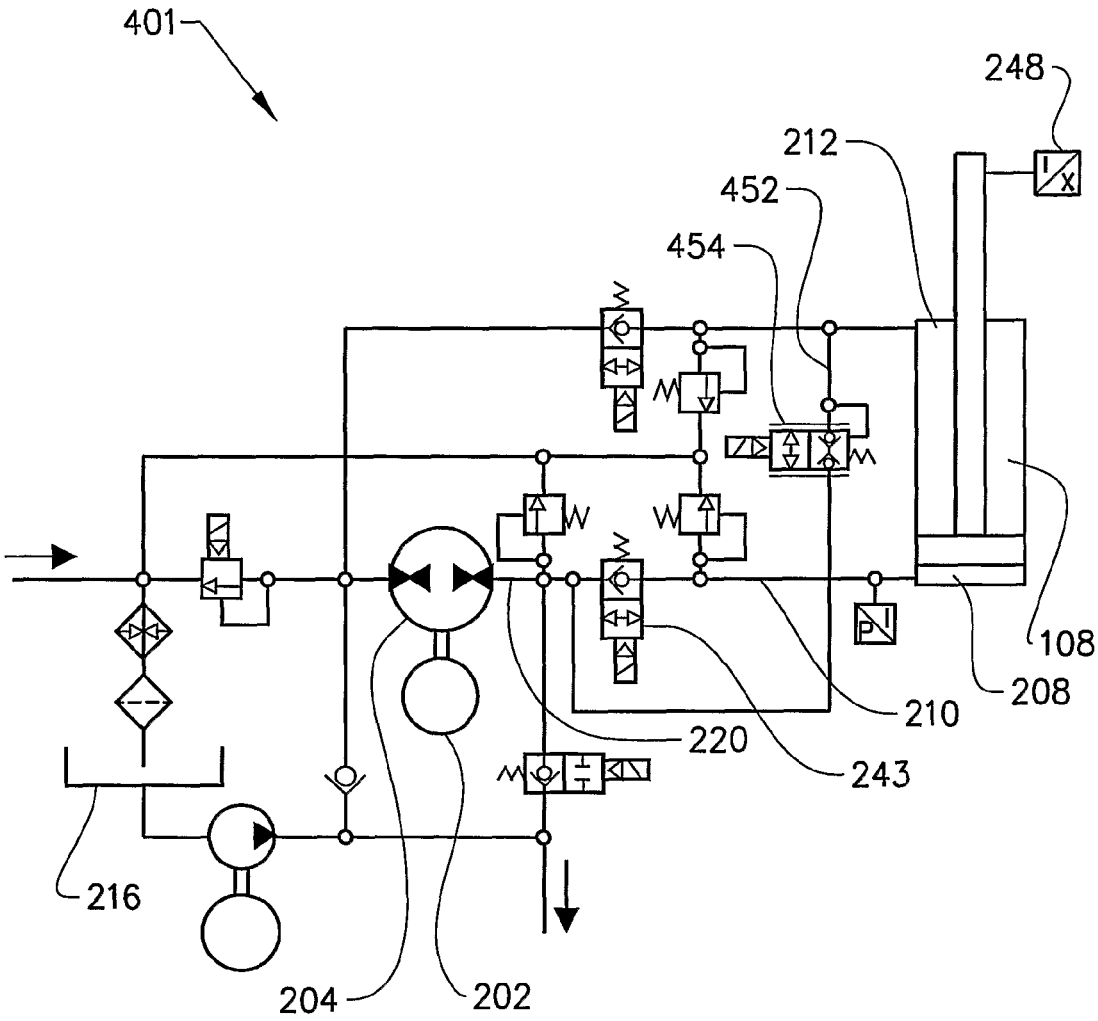

FIG. 4 shows a third embodiment of a control system 401 for carrying out raising and lowering of the lifting arm 106, see FIG. 1. Only the parts that distinguish the third embodiment from the second embodiment will be described below.

According to the third embodiment, the bypass valve 454 has an alternative connection on the piston side 208 of the hydraulic cylinder 108. The bypass line 452 is connected to the line 210 between the first port 220 of the hydraulic machine 204 and the piston side 208 between the pressure-limiting valve 243 and the hydraulic machine 204. An advantage of this is that leakage is reduced and, accordingly, unwanted lowering of the cylinder is also reduced.

FIG. 5 shows a control system for controlling the control system 201 shown in FIG. 2 for the lifting function, the tilting function, the steering function and the additional function. A control element, or control, 506 in the form of a lifting lever is arranged in the cab 114 for manual operation by the driver and is electrically connected to the control unit 502 for controlling the lifting functions.

The electric machine 202 is electrically connected to the control unit 502 in such a way that it is controlled by the control unit and can provide operating state signals to the control unit.

The control system comprises one or more energy storage means 520 connected to said electric machine 202. The energy storage means 520 can consist of or comprise a battery or a supercapacitor, for example. The energy storage means 520 is adapted to provide the electric machine with energy when the electric machine 202 is to function as a motor and drive its associated pump 204. The electric machine 202 is adapted to charge the energy storage means 520 with energy when the electric machine 202 is driven by its associated pump 204 and functions as a generator.

The wheel loader 101 also comprises a power source 522 in the form of an internal combustion engine, which usually comprises a diesel engine, for propulsion of the vehicle. The diesel engine is connected in a driving manner to the wheels of the vehicle via a drive line (not shown). The diesel engine is moreover connected to the energy storage means 520 via a generator (not shown) for energy transmission.

It is possible to imagine alternative machines/units adapted for generating electric power. According to a first alternative, use is made of a fuel cell which provides the electric machine with energy. According to a second alternative, use is made of a gas turbine with an electric generator for providing the electric machine with energy.

FIG. 5 also shows the other components which are connected to the control unit 502 according to the first embodiment of the control system for the lifting function, see FIG. 2, such as the electrically controlled valves 224, 237, 243, the position sensor 248 and the pressure sensor 228. It will be understood that corresponding components for the tilting function and the steering function and the additional function are connected to the control unit 502.

The invention is not limited to the specific hydraulic system that is shown in FIG. 2. The invention can be utilized instead for other types of hydraulic systems, such as a conventional hydraulic system in which the hydraulic pump is driven directly mechanically by the vehicle's propulsion engine (diesel engine) via a shaft and where the movements of the hydraulic cylinder are controlled by means of valves arranged on lines between the pump and the hydraulic cylinder. For example, the hydraulic system can be a load-detecting system.

Figure 6:
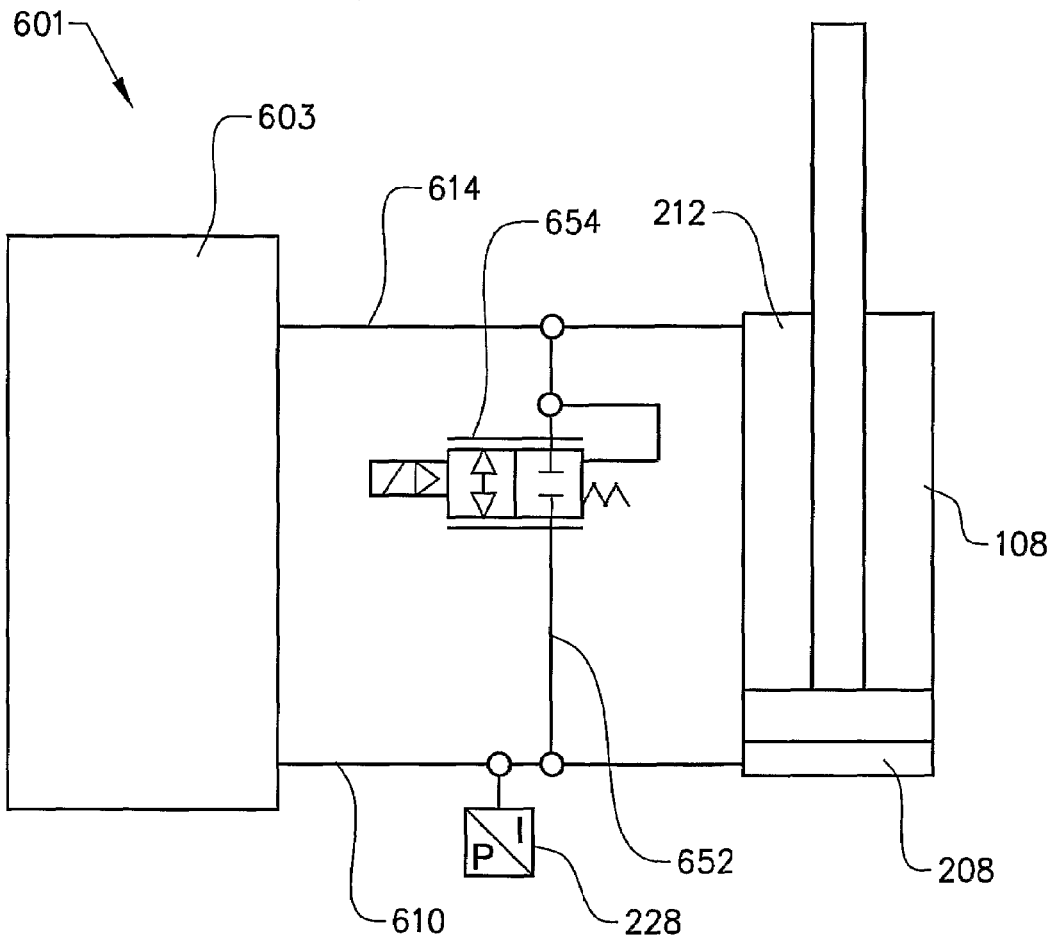
FIG. 6 shows schematically a general embodiment of the control system.

FIG. 6 shows a control system 601 in which the hydraulic system 603 is represented in general by a box. This is to be interpreted as meaning that the hydraulic cylinder 108 with the bypass line 652 between the piston side 208 and the piston-rod side 212 and the bypass valve 654 can be connected to various types of hydraulic systems.

The valve 654 is designed as a pilot-controlled pressure limiter through which a flow can pass in both directions. In the event of a flow from the piston side 208 to the piston-rod side 212, the pressure on the piston-rod side can be determined by the pilot signal. In the event of a flow from the piston-rod side 212 to the piston side 208, the valve can be kept open by means of the pilot signal (not reducing the pressure).

Figure 7:
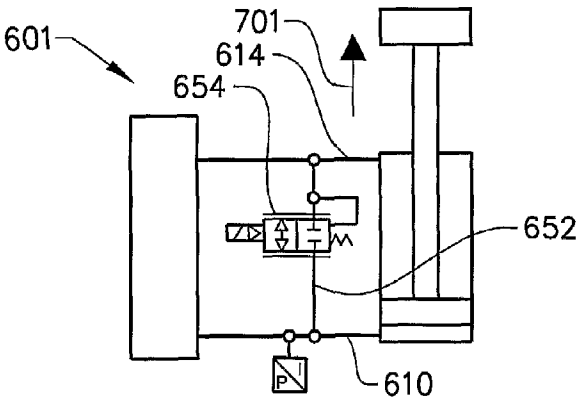
Figure 11:
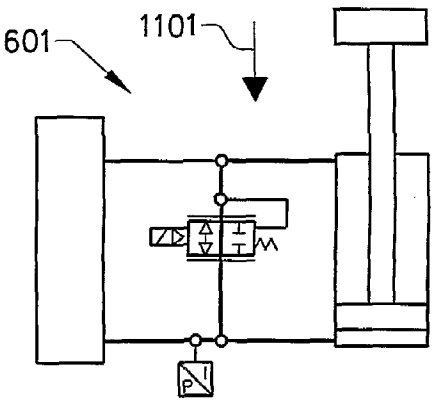

FIG. 7 shows the setting of the bypass valve 654 for a normal lifting movement, see the arrow 701: The bypass valve 654 is closed. Feed oil comes from the hydraulic system 603 to the piston side 208, and oil in the piston-rod side 212 is returned to the hydraulic system.

Figure 8:
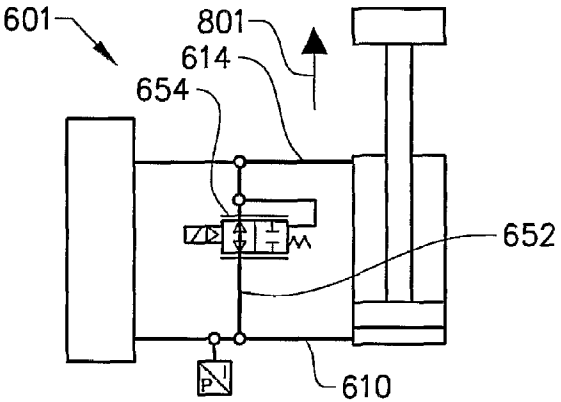
FIGS. 7-11 show the general control system according to FIG. 6 in five different operating states.

FIG. 8 shows the setting of the bypass valve 654 for a rapid lifting movement, see the arrow 801: By connecting in the bypass valve 654, a higher lifting speed can be obtained for the same feed flow. The bypass valve is fully open. Feed oil comes from the hydraulic system 603 to the piston side 208, and oil in the piston-rod side 212 passes via the bypass valve 654 to the piston side 208 (the hydraulic system remains closed with regard to the port to the piston-rod side 212). This provides an increase in the speed. The pressure level on the piston side 208 will also be increased correspondingly.

Figure 9:
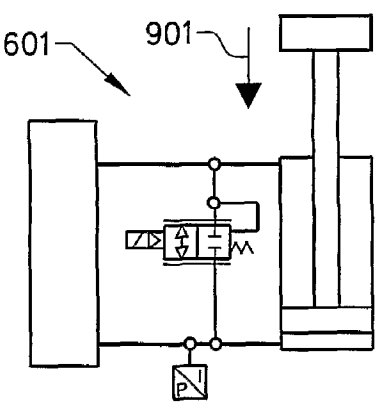

FIG. 9 shows the setting of the bypass valve 654 for a normal lowering movement, see the arrow 901: The bypass valve is closed. Feed oil comes from the hydraulic system to the piston-rod side, and oil in the piston side is returned to the hydraulic system.

Figure 10:
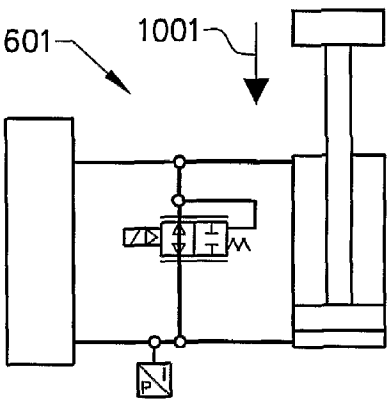

FIG. 10 shows the setting of the bypass valve 654 for a rapid lowering movement, see the arrow 1001: By connecting in the bypass valve 654, a higher lowering speed can be obtained for the same feed flow. For a work machine in the form of a loader, the highest flow is developed when lowering is carried out with a light load. With the bypass valve 654, the other flow dimensions of the hydraulic system 603 can be smaller. The pilot-controlled bypass valve 654 is fully open. During lowering, there is a refilling of oil from the piston side 208 to the piston-rod side 212 (the hydraulic system 603 is kept closed with regard to the port to the piston-rod side 212). This means that the speed is increased for the same return flow to the hydraulic system. The pressure level on the piston side 208 is also increased correspondingly. This should possibly not be used with loads that are too heavy, as the increased pressure level can exceed the pressure at which a shock valve opens or the maximum acceptable level for the components.

FIG. 10 shows the setting of the bypass valve 654 for a reduction in energy during a lowering movement, see the arrow 1101. With this system, a certain part of the lowering energy can be dumped in the oil as heat. During a lowering of the load, refilling of the piston-rod side 212 can take place through the bypass valve 654. The pressure in the piston-rod side 212 can then be adjusted to a level approaching zero during the lowering phase. The flow and pressure drop across the valve 654 then generate heat into the oil. The remainder of the oil (=piston volume−piston-rod volume) passes on to the hydraulic system 603. The amount of energy that is to be reduced can be controlled by means of the bypass valve 654. This can, for example, be used to consume energy in a system that can recover lowering energy when the energy storage means 520 is temporarily unable to receive all the energy.

The pressure sensor in combination with signals from one or more operator-controlled elements 506 (the levers) can be recorded in the control unit 502 (the computer), and this can then control when the different functions are to be connected in.

A preferred method for controlling the hydraulic cylinder 108 comprises the steps of detecting at least one operating parameter, such as an input from the lifting lever 506 and/or a direction of the piston in the hydraulic cylinder 108 and/or a load 106 acting upon the hydraulic cylinder, and of variably controlling the communication path between the piston-rod side 212 and piston side 208 of the hydraulic cylinder on the basis of the detected operating parameter.

According to one embodiment, the communication path is opened to a great extent when said operating parameter indicates a rapid movement (such as a large movement of the lever 506).

According to another embodiment, the communication path is closed when said operating parameter indicates a less rapid movement (such as a small movement of the lever 506).

According to another embodiment, the size of the detected load is compared with a predetermined load level which indicates that the load is of such a weight that a rapid lowering could be risky. If the detected load exceeds the predetermined load level, the communication path between the piston-rod side 212 and piston side 208 of the hydraulic cylinder is therefore blocked. This function has priority over the rapid lowering function that was described above. If, however, the detected load is less than the predetermined load level, the communication path between the piston-rod side 212 and piston side 208 of the hydraulic cylinder is opened up, in accordance with what was described above.

Concerning the energy reduction function, the method comprises the step of determining whether it is desirable to convert a part of the kinetic energy during a lowering movement into heat in the hydraulic fluid and, if so, controlling the communication path between the piston-rod side 212 and piston side 208 of the hydraulic cylinder correspondingly. For example, an energy level is detected in the energy storage means 522. The detected energy level is compared with a predetermined level which corresponds to the energy store being full or in principle full. If the detected energy level exceeds the predetermined level, the communication path between the piston-rod side 212 and piston side 208 of the hydraulic cylinder is restricted.

The invention is not to be regarded as being limited to the illustrative embodiments described above, but a number of further variants and modifications are conceivable within the scope of the following patent claims.

The invention claimed is:

1. A method for controlling a hydraulic cylinder, comprising detecting a load acting upon the hydraulic cylinder, controlling opening and closing of a communication path between a piston-rod side and a piston side of the hydraulic cylinder based on the detected load, the piston-rod side and the piston side being connected to a hydraulic system via first and second lines, respectively, the first and second lines being connected by a third line, by opening and closing of a valve in the third line, the controlling comprising comparing a size of the detected load with a predetermined load level, closing the valve if the detected load exceeds the predetermined load level, opening the valve if the detected load is less than the predetermined load level, and continually variably controlling the communication path between the piston-rod side and piston side of the hydraulic cylinder.

2. The method as claimed in claim 1, comprising detecting an input from an operator-controlled element and controlling the communication path between the piston-rod side and piston side of the hydraulic cylinder based on this input.

3. The method as claimed in claim 2, comprising opening up the communication path to an increasing extent when the operating parameter indicates increasingly rapid movement.

4. The method as claimed in claim 2 comprising closing off the communication path when the operating parameter indicates movement below a predetermined speed.

5. The method as claimed in claim 1, comprising determining a position of the piston in the hydraulic cylinder and controlling the communication path between the piston-rod side and piston side of the hydraulic cylinder based on the determined position.

6. The method as claimed in claim 1, comprising determining, whether it is desirable to convert a part of the kinetic energy during a lowering movement into heat in the hydraulic fluid and, if so, controlling the communication path between the piston-rod side and piston side of the hydraulic cylinder correspondingly.

7. The method as claimed in claim 1, wherein the communication involves controlling a pressure on a side of the cylinder that is opposite to a side of the cylinder toward which the piston in the hydraulic cylinder is moved.

8. The method as claimed in claim 1, wherein the valve is a pressure-reducing valve.

9. The method as claimed in claim 8, wherein the pressure-reducing valve is arranged to allow a flow in both directions.

10. The method as claimed in claim 1, comprising driving the hydraulic cylinder with a hydraulic machine.

11. The method as claimed in claim 10, wherein the communication path is controlled so that hydraulic fluid from a first of the piston-rod side and piston side flows to the second of the piston side and piston-rod side without passing through the hydraulic machine.

12. The method as claimed in claim 1, wherein the hydraulic cylinder is arranged in a work machine and moves an implement that is connected to the hydraulic cylinder.

13. The method as claimed in claim 12, wherein the load acts on the implement.

14. A method for controlling a hydraulic cylinder, comprising detecting at least one operating, parameter, controlling opening and closing of a communication path between a piston-rod side and a piston side of the hydraulic cylinder based on the detected operating parameter, detecting an energy level in an energy storage means, comparing the detected energy level with a predetermined level, and restricting the communication path between the piston-rod side and piston side of the hydraulic cylinder if the detected energy level exceeds the predetermined level.

15. A control system for a work machine comprising at least one hydraulic cylinder comprising a piston defining a piston-rod side and a piston side of the cylinder, a hydraulic system, the piston-rod side and the piston side being connected to the hydraulic system via first and second lines, respectively, the first and second lines being connected by a third line, an openable and closable valve in the third line for controlling a communication path between the piston-rod side and the piston side of the hydraulic cylinder, a sensor arranged to detect a load acting upon the hydraulic cylinder, and a controller arranged to control opening and closing of the valve in response to the load detected by the sensor, the controller being arranged to compare a size of the detected load with a predetermined load level, close the valve if the detected load exceeds the predetermined load level, and open the valve if the detected load is less than the predetermined load level, the controller being arranged to continually variably control the communication path between the piston-rod side and piston side of the hydraulic cylinder.

16. The control system s claimed in claim 15, wherein the valve comprises an electrically controlled valve.

17. The control system as claimed in claim 15, wherein the control system comprises an operator-controlled element.

18. The control system as claimed in claim 15 wherein the sensor comprises a pressure sensor arranged on the piston side of the hydraulic cylinder.

19. The control system as claimed in claim 15, wherein the control system comprises means for determining a position of the piston in the hydraulic cylinder.

20. The control system as claimed in claim 15, wherein the controller comprises a control unit that is operatively connected to the valve in order to control the valve.

21. The control system as claimed in claim 15, wherein the hydraulic cylinder is adapted to more an implement in order to perform a work function.

22. The control system as claimed in claim 21, wherein the hydraulic cylinder comprises a lifting cylinder for moving a loading arm which is pivotably connected to a vehicle frame, the implement being arranged on the loading arm.

23. The control system as claimed in claim 21, wherein the hydraulic cylinder comprises a tilting cylinder for moving the implement, which is pivotably connected to a loading arm, which is in turn pivotably connected to a vehicle frame.

* * * * *